US008764343B1

(12) United States Patent
Hawkins, Sr. et al.

(10) Patent No.: US 8,764,343 B1
(45) Date of Patent: Jul. 1, 2014

(54) BOAT-LAUNCHING DEVICE, SYSTEM, AND METHOD

(71) Applicant: Hawkins Marine Accessories, LLC, Wyoming, MN (US)

(72) Inventors: David J. Hawkins, Sr., Wyoming, MN (US); David J. Hawkins, Jr., Coon Rapids, MN (US)

(73) Assignee: Hawkins Marine Accessories, LLC, Wyoming, MN (US)

( * ) Notice: Subject to any disclaimer, the term of this patent is extended or adjusted under 35 U.S.C. 154(b) by 0 days.

(21) Appl. No.: 14/106,407

(22) Filed: Dec. 13, 2013

(51) Int. Cl.

| | |
|---|---|
| ***B63C 3/02*** | (2006.01) |
| ***B63B 21/20*** | (2006.01) |
| ***B63C 13/00*** | (2006.01) |
| ***B63B 21/16*** | (2006.01) |

(52) U.S. Cl.
CPC ..... *B63C 13/00* (2013.01); *B63B 21/20* (2013.01); *B63B 21/16* (2013.01)
USPC ..... 405/1

(58) Field of Classification Search
USPC ..... 405/1; 280/414.1; 441/24, 25
See application file for complete search history.

(56) References Cited

U.S. PATENT DOCUMENTS

| | | | | |
|---|---|---|---|---|
| 4,162,095 | A * | 7/1979 | Archer | 294/74 |
| 5,078,541 | A * | 1/1992 | Gola | 405/1 |
| 5,256,093 | A * | 10/1993 | Balstad | 441/25 |
| 5,839,179 | A * | 11/1998 | Parker | 29/235 |
| 6,880,285 | B1 * | 4/2005 | Frost et al. | 43/15 |
| 2004/0026557 | A1 * | 2/2004 | Lilly | 242/381 |
| 2007/0214703 | A1 * | 9/2007 | McKelvey | 43/15 |

* cited by examiner

*Primary Examiner* — Benjamin Fiorello
*Assistant Examiner* — Kyle Armstrong
(74) *Attorney, Agent, or Firm* — Fish & Richardson P.C.

(57) ABSTRACT

A boat-launching device can include a shock cord and a spring-loaded reel. The shock cord can have a proximal end adapted to be secured to a dock. The spring-loaded reel can include a reel casing, a spool, and a reel spring. The reel casing can define a reel opening. The shock cord can be wound on the spool and have a distal end attached to the spool and the proximal end extending out of the reel opening. A fastener can be attached to the reel casing and adapted to be secured to a boat.

19 Claims, 3 Drawing Sheets

BOAT-LAUNCHING DEVICE, SYSTEM, AND METHOD

TECHNICAL FIELD

This document relates to a devices and methods for launching a boat.

BACKGROUND

Launching a boat from a trailer normally requires two people. As a driver backs the trailer holding a boat into the water, the boat must separate from the trailer. One method to remove the boat involves backing the trailer into the water with sufficient momentum for the boat to glide off the trailer, but this requires that the boat be unsecured to the trailer. During the unloading process using momentum, however, boats can come off the trailer and into the water with significant momentum, which can cause the boat to float away. To make sure that the boat does not float away, one or more additional people can hold one or more ropes secured to the boat in order to ensure that the boat does not float away or ram against an adjacent dock. Boaters, however, sometimes enjoy boating alone or with individuals unable to help with the boat unloading process. Simply tying a rope between a dock and a boat during an unloading process, however, can be dangerous as the rope can become tangled in the trailer, the momentum of the boat can jerk the dock and damage the dock, or cause a recoil that causes the boat to smash into the dock. Other people may try to launch a boat by positioning the boat and trailer in the water and physically pushing the boat off the trailer, which can cause physical injury and require that the boater get into the water. There is thus a need for a boat-launching device that improves safety and allows users to stay dry.

SUMMARY

Boat-launching devices provided herein can assist the launching of a boat such that a single individual can safely launch the boat into a body of water. In some cases, a boat-launching device provided herein includes a shock cord and a spring-loaded reel. The shock cord can have a proximal end adapted to be secured to a dock. The spring-loaded reel can include a reel casing, a spool, and a reel spring. The reel casing can define a reel opening. The shock cord can be wound on the spool and have a distal end attached to the spool and the proximal end extending out of the reel opening. A fastener can be attached to the reel casing and adapted to be secured to a boat.

Shock cord in a boat-launching device provided herein can stretch to slowly stop the momentum of a boat as it is launched and provide a force directing the boat back towards a dock. In some cases, shock cord in a boat-launching device provided herein can have an elastic core. In some cases, shock cord in a boat-launching device provided herein can have a woven sheath over an elastic core. For example, a woven sheath can include nylon, polypropylene, or another non-elastic material. The sheath does not materially extend elastically, but it is braided with its strands spiraling around the core so that a longitudinal pull causes it to squeeze the core, transmitting the core's elastic compression to the longitudinal extension of the sheath and cord, and providing the shock cord with a maximum length of stretching prior to failure. When a boat is launched using a boat-launching device provided herein, the amount of force on the shock cord can depend on the speed of the launch, the weight of the boat, and the weather conditions.

In some cases, a boat-launching device provided herein can provide a stretching of the shock cord by at least 6 inches prior to the shock cord being fully unwound from the spool when launching a boat In some cases, the shock cord can have a stretched length that is at least 25% greater than its non-stretched length. In some cases, the shock cord can have a stretched length that is at least 40% greater than its non-stretched length. In some cases, the shock cord can have a stretched length that is at least 50% greater than its non-stretched length. In some cases, the shock cord can have a stretched length that is at least 60% greater than its non-stretched length. In some cases, the shock cord can have a stretched length that is at least 70% greater than its non-stretched length. In some cases, the shock cord can have a stretched length that is at least 80% greater than its non-stretched length. In some cases, the shock cord can have a stretched length that is at least 90% greater than its non-stretched length. In some cases, the shock cord can have a stretched length that is at least 100% greater than its non-stretched length. In some cases, the shock cord can have a stretched length that is at least 120% greater than its non-stretched length. In some cases, the shock cord can have a stretched length that is up to 200% greater than its non-stretched length. In some cases, the shock cord can have a stretched length that is up to 150% greater than its non-stretched length. In some cases, the shock cord can have a stretched length that is up to 125% greater than its non-stretched length. In some cases, the shock cord can have a stretched length that is up to 100% greater than its non-stretched length. In some cases, the shock cord can have a stretched length that is between 70% and 125% greater than its non-stretched length. In some cases, the shock cord can have a stretched length that is between 90% and 100% greater than its non-stretched length. For example, a shock cord can have a maximum length that is about 124% greater than the non-stretched length (i.e., a shock cord having a non-stretched length of 12.5 feet can be stretch to a maximum length of about 29 feet).

Shock cord in a boat-launching device provided herein can be any suitable length. In some cases, the shock cord in a boat-launching device provided herein can be at least 5 feet. In some cases, the shock cord in a boat-launching device provided herein can be at least 10 feet. In some cases, the shock cord in a boat-launching device provided herein can be at least 15 feet. In some cases, the shock cord in a boat-launching device provided herein can be at least 20 feet. In some cases, the shock cord in a boat-launching device provided herein can be at least 25 feet. In some cases, the shock cord in a boat-launching device provided herein can be at least 30 feet. In some cases, the shock cord in a boat-launching device provided herein can be up to 50 feet. In some cases, the shock cord in a boat-launching device provided herein can be up to 40 feet. In some cases, the shock cord in a boat-launching device provided herein can be up to 30 feet. For example, the shock cord can be about 13 feet.

A proximal end of the shock cord in a boat-launching device provided herein can, in some cases, include a rigid rod. A rigid rod provided herein can press between a dock and the reel casing to inhibit the boat from impacting a side of the dock. In some cases, the rigid rod can have a length of at least 4 inches. In some cases, the rigid rod can have a length of at least 6 inches. In some cases, the rigid rod can have a length of at least 8 inches. In some cases, the rigid rod can have a length of at least 10 inches. In some cases, the rigid rod can have a length of at least 12 inches. In some cases, the rigid rod can have a length of up to 50 inches. In some cases, the rigid rod can have a length of at least up to 40 inches. In some cases, the rigid rod can have a length of up to 30 inches. In some cases, the rigid rod can have a length of between 6 inches and 30 inches. In some cases, the rigid rod can be replaced with another stay-away object having a non-rod shape.

In some cases, a rigid rod provided at the proximal end of the shock cord can be a hollow tube. For example, the shock cord can extend through the hollow tube and be secured to a stopper. In some cases, the rigid rod is a piece of PVC pipe. A rigid rod provided herein can also serve as a handle for the user. In some cases, a rigid rod provided herein includes a grip.

A proximal end of the shock cord of a boat-launching device provided herein can be adapted to be attached to a portion of a dock. In some cases, a proximal end of the shock cord comprises a loop. In some cases, the proximal end of the shock cord can be formed into a loop. In some cases, a fabric loop can be attached to the proximal end of the shock cord. For example, the proximal end of the shock cord can be connected to an adjustable hook with a safety latch and a fabric loop can be attached to an opposite end of the adjustable hook with the safety latch.

A fastener attached to the reel casing provided herein can be adapted to be attached to a boat. In some cases, the fastener can be a clasp, climbers hook, metal hook, strap system, or any other suitable fastener adapted to connect to part of a boat. In some cases, the fastener is a carabiner. In some cases, the carabiner can be an aluminum carabiner. In some cases, the carabiner can be a three-inch carabiner. In some cases, a fastener (e.g., a carabiner) can be attached to the reel casing by a rotating anchor. The fastener can be adapted to bow hook at the front of a boat and/or cleats on the sides of the boat.

A boat-launching device provided herein can include a spring-loaded reel that includes an internal spring configured to provide a pulling force on a shock cord to rewind the shock cord into the spring-loaded reel. In some cases, the spring-loaded reel can provide at least 10 $lb_f$ of force pulling on the shock cord. In some cases, the spring-loaded reel can provide at least 50 $lb_f$ of force pulling on the shock cord. In some cases, the spring-loaded reel can provide at least 100 $lb_f$ of force pulling on the shock cord. In some cases, the spring-loaded reel can provide at least 150 $lb_f$ of force pulling on the shock cord. In some cases, the spring-loaded reel can provide at least 200 $lb_f$ of force pulling on the shock cord. In some cases, the spring-loaded reel can provide at least 250 $lb_f$ of force pulling on the shock cord. In some cases, the spring-loaded reel can provide at least 300 $lb_f$ of force pulling on the shock cord. In some cases, the spring-loaded reel can provide at least 350 $lb_f$ of force pulling on the shock cord. In some cases, the spring-loaded reel can provide at least 400 $lb_f$ of force pulling on the shock cord. In some cases, the spring-loaded reel can provide up to 2,000 $lb_f$ of force pulling on the shock cord. In some cases, the spring-loaded reel can provide up to 1,500 $lb_f$ of force pulling on the shock cord. In some cases, the spring-loaded reel can provide up to 1,000 $lb_f$ of force pulling on the shock cord. In some cases, the spring-loaded reel can provide up to 800 $lb_f$ of force pulling on the shock cord. In some cases, the spring-loaded reel can provide up to 600 $lb_f$ of force pulling on the shock cord. In some cases, the spring-loaded reel can provide up to 500 $lb_f$ of force pulling on the shock cord. In some cases, the spring-loaded reel can provide up to 400 $lb_f$ of force pulling on the shock cord. For example, a spring-loaded reel provided herein can provide between 300 lbf and 500 lbf of force pulling on the shock cord. In some cases, the spring-loaded reel can be adapted to provide a pulling force on the shock cord that increases as the shock cord is unwound from the spool.

A spring-loaded reel used in a boat-launching device provided herein can include an axel, about which the spool rotates, where the axel being secured to the reel casing and the reel spring is secured between the spool and the axel such that rotation of spool within the reel casing causes the reel spring to deform. In some cases, the reel spring can be a piece of metal (e.g., stainless steel, nitinol). The reel spring can be a torsion spring.

A method of launching a boat provided herein can include a step of positioning a boat on a trailer adjacent a dock, attaching a boat-launching provided herein between the boat and the dock, and moving the boat and the trailer into a body of water such that the boat begins to float and moves away from the trailer with the boat-launching device providing a force to pull the boat towards the dock. As the boat is backed up and off of the trailer, the boat can have significant momentum. Because the shock cord is stretchable and the spring-loaded reel provides a pulling force on the shock cord, the boat-launching device can gradually slow this momentum as the boat moves away from the trailer, which can reduce the probability of the launching of the boat causing damage to the boat or the dock. The spring-loaded reel can also keep the shock cord tensioned such that it is less likely to drag on the ground, drop into the water, or get tangled in the trailer. Moreover, because this device can be used alone, it avoids boaters from getting in the water and attempting to physically push the boat off of a trailer, thus boat-launching devices provided herein improve safety and allow users to stay dry. A rigid rod at the proximal end of the shock cord can reduce the likelihood that the boat will impact the dock upon the return of the boat to the dock. In some cases, two or more boat-launching devices provided herein can be attached between the dock and the boat. In some cases, a first boat-launching device can be attached to the bow of a boat and a second boat-launching device can be attached to a bulwark.

The details of one or more embodiments of boat-launching devices are set forth in the accompanying drawings and the description below. Other features and advantages will be apparent from the description and drawings, and from the claims.

DESCRIPTION OF DRAWINGS

Like reference symbols in the various drawings indicate like elements.

DETAILED DESCRIPTION

This document describes devices and methods for launching boats. Launching a boat into a body of water with a single person can be difficult, given the need to detach the boat from the trailer so that it moves off of the trailer when the boat is backed up into the water. The boat/trailer combination must be backed up with sufficient momentum to allow for the boat to slide off the trailer, but this momentum can set the boat adrift. Tying a rope between the boat and the trailer/dock can damage the boat, trailer, and/or dock as the boat can recoil back towards the trailer/dock. Moreover, the momentum can provide a jerking force when the rope is fully extended such that the boat, trailer, and/or dock are damaged. Boat-launching devices provided herein can be attached between a boat and another structure (e.g., a dock) such that a single individual can launch a boat, but avoid sending the boat adrift or damaging the boat, dock, or other equipment.

Figure 1:
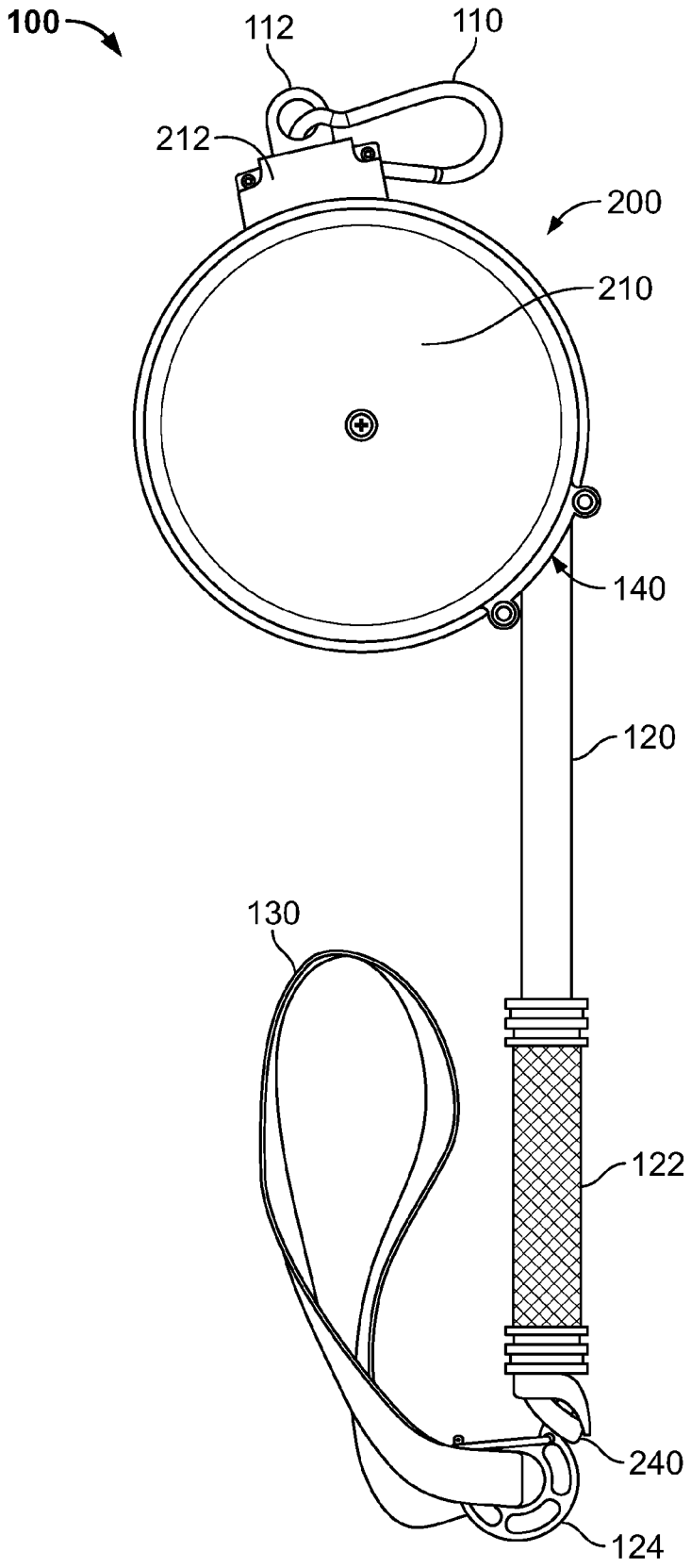
FIG. 1 is a perspective view of an exemplary boat-launching device provided herein.
Figure 2:
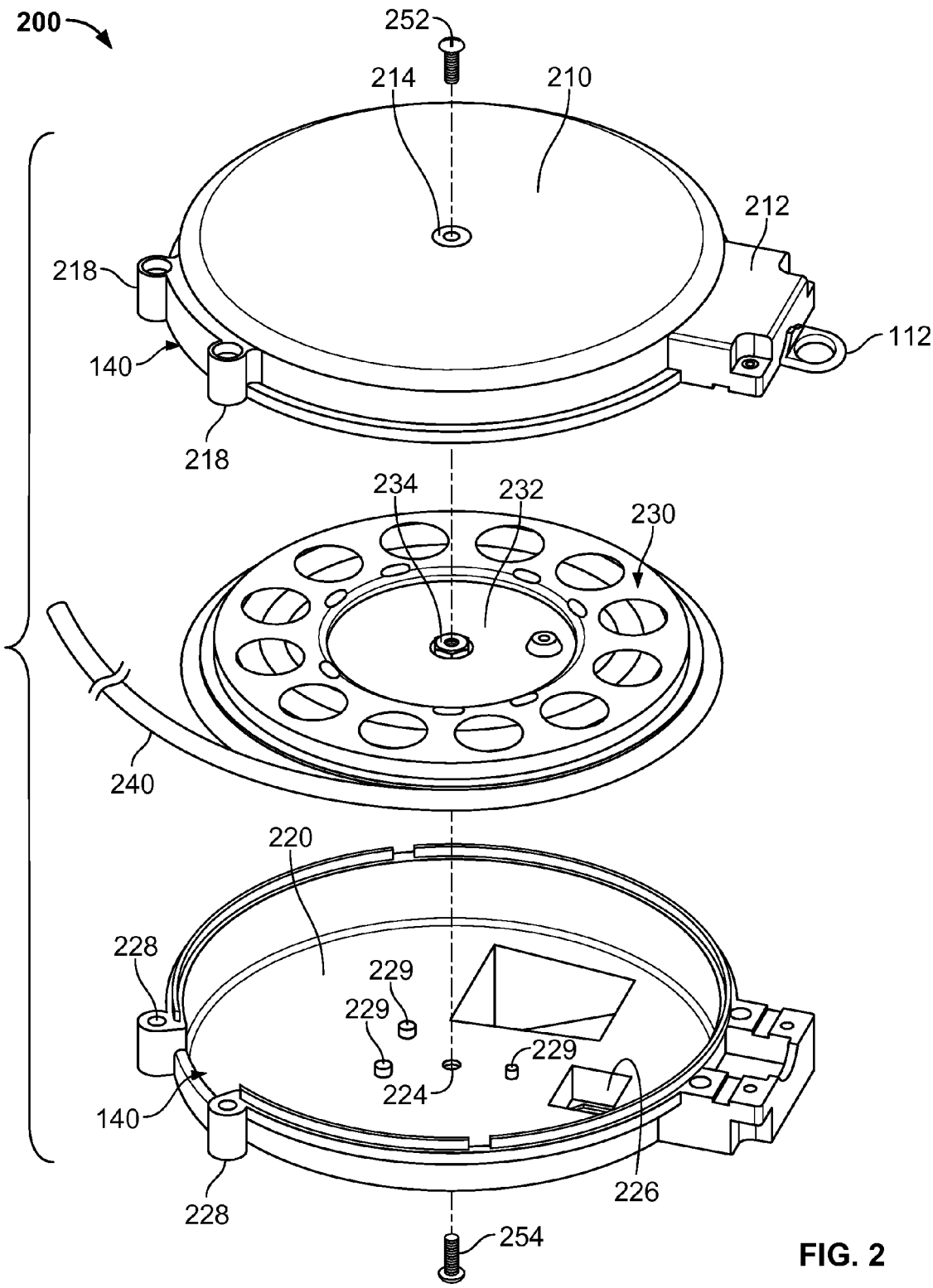
FIG. 2 is an expanded view of a spring-loaded reel of the exemplary boat launching device of FIG. 1.

FIG. 1 is a perspective view of an exemplary boat-launching device 100 provided herein. FIG. 2 is an expanded view of a spring-loaded reel 200 of the exemplary boat launching device 100 of FIG. 1. As shown, boat-launching device 100 includes a shock cord 240 and a spring-loaded reel 200. Shock cord 240 can have a proximal end adapted to be secured to a dock. Spring-loaded reel 200 can include a reel casing, which can include real casing halves 210 and 220, a spool 230, and a reel spring (not shown). Reel casing halves 210 and 220 can be secured together with rivets passing through apertures 218 and 228. Reel casing halves 210 and 220 can define a reel opening 140, through which shock cord 240 can extend. Shock cord 240 can be wound on the spool 230 and have a distal end attached to spool 230 along the inside of spool 230. A fastener 110 can be attached to the reel casing halves 210 and 220 and adapted to be secured to a boat.

Shock cord 240 can exit spring-loaded reel 200 through opening 140 as the boat is launched. As shock cord 240 unwinds off spool 230, a spring (e.g., a torsion spring) can bend or wind to provide a pulling force on shock cord 240. Moreover, shock cord 240 can elastically stretch. Spring-loaded reel 200 and elastic shock cord 240 can thus provide a counter force to slowly stop the momentum of a boat as it is launched and direct the boat back towards a dock or another stationary structure.

Shock cord 240 can have an elastic core. Shock cord 240 can have a woven sheath over an elastic core. In some cases, a woven sheath of shock cord 240 can include nylon, polypropylene, or another non-elastic material. A woven sheath of a non-elastic material can spiral around the elastic core so that a longitudinal pull causes the sheath to squeeze the core, transmitting the core's elastic compression to the longitudinal extension of the sheath and cord, and providing the shock cord with a maximum length of stretching prior to failure. Shock cord 240 can have a non-stretched length of between 5 feet and 50 feet, but stretch to a length of a length of at least 50 percent greater than the non-stretched length. In some cases, shock cord 240 can have a length of between 10 feet and 25 feet and have a stretched length of at least 70 percent greater than the non-stretched length.

A proximal end of shock cord 240 includes a rigid rod 120. Rigid rod 120 can press between a dock and spring-loaded reel 200 to inhibit the boat from impacting a side of the dock. Rigid rod 120 can have a length of between about 10 inches and about 18 inches. As shown, rigid rod 120 can be a hollow tube and have shock cord 240 extend there through. Shock cord 240 can be secured to an adjustable safety latch 124 at a proximal end of rigid rod 120. Adjustable safety latch 124 can have a diameter greater than an inside diameter of rigid rod 120 so that the anchor does not pass through rigid rod 120. In some cases, rigid rod 120 can be a piece of PVC pipe. In some cases, any suitable polymeric material can be used. In some cases, rigid rod 120 includes a metal or a ceramic. In some cases, not shown, rigid rod 120 can be solid and shock cord 240 can be attached to a distal end of rigid rod 120. Rigid rod 120 can include a grip 122, which can be gripped by a user when shock cord 240 is being drawn out by the user to attach boat-launching device 100 between a boat and a dock.

Adjustable safety latch 124 can secure a fabric loop 130 to shock cord 240. Adjustable safety latch 124 can be any suitable material (e.g., a plastic material, a metallic material, a ceramic material). Fabric loop 130 can be any suitable material. In some cases, fabric loop 130 can include nylon. Fabric loop 130 can have any suitable circumference. In some cases, fabric loop 130 can have a circumference between 12 inches and 36 inches (e.g., about 24 inches). In some cases, the proximal end of the shock cord can be formed into a loop. In some cases, other fastening devices can be attached to a proximal end of shock cord 240 (e.g., at a proximal end of rigid rod 120) in order to secure a proximal end of shock cord 240 to a dock or other suitable stationary object.

Fastener 110 can be attached to spring-loaded reel 200. Fastener 110 can be adapted to be attached to a boat. In some cases, fastener 110 can be a clasp, climbers hook, metal hook, strap system, or any other suitable fastener adapted to connect to part of a boat. As shown, fastener 110 is a carabiner. In some cases, carabiner 110 can be an aluminum carabiner. In some cases, carabiner 110 can be a three-inch carabiner. In some cases, fastener 110 can be attached to the reel casing by a rotating anchor 112. Rotating anchor 112 can be secured to an extending portion 212 of the casting. Fastener 110 can be adapted to bow hook 312 (FIG. 3) at the front of a boat and/or cleats 314 (FIG. 3) on the sides of the boat.

An internal spring within spring-loaded reel 200 is configured to provide a pulling force on a shock cord to rewind the shock cord into the spring-loaded reel. In some cases, spring-loaded reel 200 can provide between 300 $lb_f$ and 500 $lb_f$ of force pulling on the shock cord (e.g., about 375 $lb_f$). In some cases, the spring-loaded reel can be adapted to provide a pulling force on shock cord 240 that increases as shock cord 240 is unwound from spool 320. In some cases, an internal spring within spring-loaded reel 200 is a torsion spring, which works by torsion or twisting to store mechanical energy when it is twisted. As shock cord 240 is pulled out of spring-loaded reel 200, the torsion spring can twist or bend and exert a force (specifically a torque) in the opposite direction, proportional to the amount (angle) it is twisted. In some cases, a torsion spring can be a torsion bar, which can be a straight bar of metal and/or plastic. In some cases, a torsion spring can be a helical torsion spring, is a metal rod or wire in the shape of a helix that is subjected to twisting about the axis of the coil by sideways forces (bending moments) applied to its ends as shock cord 240 is unwound, thus twisting the helix tighter.

As shown in FIG. 2, an axel 234 can extend through a central portion 232 of spool 230. In central portion 232, a torsion spring can be connected between a wall of the spool 230 and axel 234 such that the relative rotation of spool 230 and axel 234 causes the torsion spring 230 to bend or twist. Opposite ends of axel 234 are secured to reel casing halves 210 and 220 with screws 252 and 254 through apertures 214 and 224 such that it does not rotate relative to the reel casing halves 210 and 220. Reel casing halves 210 and 220 can be secured together using rivets through apertures 218 and 228, and optionally additional connections points around the reel casing body. For example, an inside surface of reel casing half 210 can fit with a hex head of axel 234. When assembled, an internal torsion spring can be pretensioned such that spring-loaded reel 200 provides a pulling force on shock cord 240 even without it being extended. A proximal end of shock cord 240 can be attached to a structure adapted to prevent winding onto spool 230. As shown in FIG. 1, rigid rod 120 can extend into opening 140, but does not wind onto spool 230. By extending into opening 140, rigid rod 120 and spring-loaded reel 200 can interconnect so that boat-launching device 100 provides spacing between the boat and the dock to reduce the probability of a damaging collision between the boat and the dock. By having rigid rod 120 interconnect with spring-loaded reel 200, boat-launching device 100's pressing is directed towards the connection point on the boat.

Referring again to FIG. 2, reel casing half 220 includes a window 226, which can allow a user to observe the winding of shock cord 240 on the spool and/or allow water to drain from the reel casing if it falls into the water. Reel casing half 220 can include internal projections 229, which can interact with a surface of spool 230 to guide a rotation of spool 230.

Figure 3:
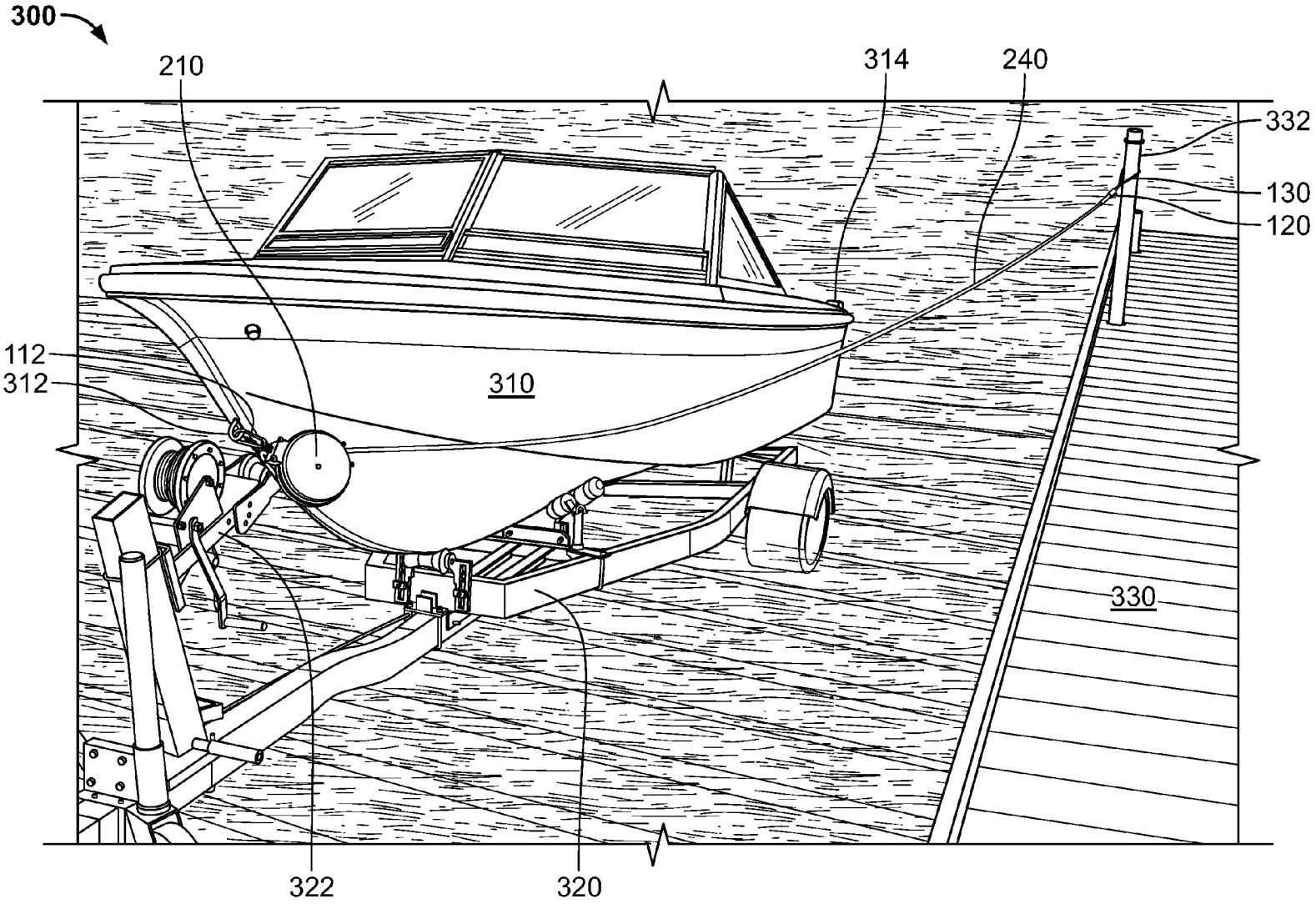
FIG. 3 depicts how a boat-launching device provided herein can be attached to a boat on a trailer and to a dock prior to launching a boat into a body of water.

FIG. 3 depicts how a boat-launching device provided herein can be attached to a boat 310 on a trailer 320 and to a dock 330 prior to launching the boat 310 into a body of water. A method of launching a boat 310 provided herein can include an initial step of positioning a boat on a trailer adjacent a dock 330 at a launching site (e.g., a ramp). The boat and trailer combo 300 can be attached to an automobile, and a driver of the automobile can back boat/trailer combo 300 on a ramp adjacent to a dock 330 so that the back wheels of trailer 320 are in the water, but driver/user can disconnect the boat from the trailer (e.g., disconnect the bow from winch 322). Once boat 310 is disconnected from trailer 320, a driver/user can attach fastener 110 to the bow of boat 310. A driver/user can then grab handle grip 122 and unwind shock cord 240 by pulling on rigid rod 120 and place fabric loop 130 around a poll 332 on dock 330. Once boat-launching device 100 is attached between the boat and the dock, a user/driver can get back in the automobile and back boat/trailer combo 300 further back into the body of water such that boat 310 begins to be supported by the water and slips off of trailer 320. Because of the pulling force provided by spring-loaded reel 200 and the elasticity of shock cord 240, boat-launching device can gradually counter the momentum of boat 310 and eventually pull boat 310 back towards the dock 330. The spring-loaded reel can also keep the shock cord tensioned such that it is less likely to drag on the ground, drop into the water, or get tangled in the trailer. A rigid rod at the proximal end of the shock cord can reduce the likelihood that the boat will impact the dock upon the return of the boat to the dock. In some cases, a distal end of rigid rod 120 can extend into opening 140 of reel casing such that force from rigid rod 120 spacing boat 310 from dock 330 is directed to the attachment location of fastener 110. In some cases, two or more boat-launching devices provided herein can be attached between the dock and the boat. In some cases, a first boat-launching device can be attached to the bow of a boat and a second boat-launching device can be attached to a bulwark. In some cases, a single boat-launching device can be used for boats that are less than 20 feet long and/or less than 2,600 lbs. In some cases, two or more boat-launching devices can be used for boats that are between 20 and 30 feet and/or weigh less than 6,000 lbs.

As discussed above, the use of a boat-launching device provided herein can avoid having ropes become tangled with the wheels. Moreover, a boat-launching device provided herein can allow a user/driver to use the momentum of the boat to unload the boat from the trailer, thus a user does not need to try to physically push the boat off the trailer once the boat/trailer combo is positioned in the water. Physically pushing the boat of the trailer can cause physical injury and require that the user get into the water, which can be cold. Accordingly, use of a boat-launching device provided herein can allow a user to safely launch a boat and stay dry.

What is claimed is:

1. A boat-launching device comprising:

(a) a shock cord having a proximal end adapted to be secured to a dock;

(b) a spring-loaded reel comprising a reel casing, a spool, and a reel spring, the reel casing defining a reel opening, the shock cord being wound on the spool and having a distal end attached to the spool and the proximal end extending out of the reel opening;

(c) a fastener attached to the reel casing, the fastener being adapted to be secured to a boat;

(d) a rigid rod at the proximal end of the shock cord, the rigid rod having a length of at least 4 inches and being adapted to press between a dock and said reel casing to inhibit a boat from impacting the dock when the boat is approaching the dock as said spring-loaded reel is pulling the boat towards the dock.

2. The boat-launching device of claim 1, wherein the shock cord comprises an elastic core.

3. The boat-launching device of claim 2, wherein the shock cord comprises a woven sheath.

4. The boat-launching device of claim 1, wherein the rigid rod is a tube and at least a portion of the proximal end of the shock cord extends through the rigid rod.

5. The boat-launching device of claim 1, wherein the rigid rod is between 6 inches and 30 inches long.

6. The boat-launching device of claim 1, wherein the rigid rod comprises a grip.

7. The boat-launching device of claim 1, wherein the proximal end of the shock cord comprises a fabric loop adapted to be secured to at least a portion of a dock.

8. The boat-launching device of claim 1, wherein the fastener attached to the reel casing is a carabiner.

9. The boat-launching device of claim 8, wherein the carabiner is attached to the reel casing by a rotating anchor.

10. The boat-launching device of claim 1, wherein the spring-loaded reel provides at least 100 $lb_f$ of force pulling on the shock cord.

11. The boat-launching device of claim 10, wherein the spring-loaded reel provides at least 300 $lb_f$ of force pulling on the shock cord.

12. The boat-launching device of claim 10, wherein the spring-loaded reel provides between 300 $lb_f$ and 500 $lb_f$ of force pulling on the shock cord.

13. The boat-launching device of claim 1, wherein the spring-loaded reel provides a pulling force on the proximal end of the shock cord that increases as the shock cord is unwound from the spool.

14. The boat-launching device of claim 1, wherein the reel further comprising an axel about which the spool rotates, the axel being secured to the reel casing, the reel spring being secured between the spool and the axel such that rotation of spool within the reel casing causes the reel spring to deform.

15. A boat-launching method, comprising:

(a) positioning a boat on a trailer adjacent a dock;

(b) providing a boat-launching device, the boat-launching device comprising:

a shock cord having a proximal end and a distal end, a spring-loaded reel comprising a reel casing, a spool, and a reel spring, the reel casing defining a reel opening, the shock cord being wound on the spool and having the distal end attached to the spool and the proximal end extending out of the reel opening, the proximal end comprising a rigid rod having a length of at least 4 inches, and a fastener attached to the reel casing (c) attaching the fastener to the boat;

(d) attaching the proximal end of the shock cord to the dock; and (e) moving the boat and the trailer into a body of water such that the boat begins to float and moves away from the trailer, wherein the boat-launching device provides at least 100 $lb_f$ to pull the boat towards the dock, wherein the rigid rod presses between the dock and said reel casing to inhibit the boat from impacting the dock when the boat arrives at the dock.

16. The method of claim 15, wherein the method comprises attaching at least two boat-launching devices between the dock and the boat.

17. The method of claim 15, wherein the shock cord comprises an elastic core and a woven sheath.

18. The method of claim 15, the rigid rod is at least 6 inches, the proximal end further comprising a fabric loop, wherein attaching the proximal end of the shock cord to the dock comprises placing the fabric loop around an upwardly projecting portion of the dock.

19. The method of claim 15, wherein the fastener attached to the reel casing is a carabiner attached to the reel casing by a rotating anchor.

* * * * *